US006578218B2

(12) United States Patent
Wassilefsky

(10) Patent No.: US 6,578,218 B2
(45) Date of Patent: Jun. 17, 2003

(54) LEG SPACER PILLOW

(75) Inventor: Gerda Wassilefsky, Odense (DK)

(73) Assignee: Tempur World, Inc., Lexington, KY (US)

( * ) Notice: Subject to any disclaimer, the term of this patent is extended or adjusted under 35 U.S.C. 154(b) by 0 days.

(21) Appl. No.: 10/021,276

(22) Filed: Dec. 7, 2001

(65) Prior Publication Data

US 2002/0088057 A1 Jul. 11, 2002

Related U.S. Application Data

(63) Continuation-in-part of application No. 29/137,361, filed on Feb. 16, 2001.

(30) Foreign Application Priority Data

Dec. 7, 2000 (DK) ..... MA 2000 01344

(51) Int. Cl.[7] ..... A47C 16/00; A47C 20/00
(52) U.S. Cl. ..... 5/648; 5/630; 5/640; 5/645
(58) Field of Search ..... 5/648, 630, 632, 5/640, 645, 490

(56) References Cited

U.S. PATENT DOCUMENTS

| | | | | |
|---|---|---|---|---|
| D28,903 | S | 6/1898 | Amory | |
| 1,312,886 | A | 8/1919 | Bawden | |
| 2,013,481 | A | 9/1935 | Stonehill | |
| 2,056,767 | A | 10/1936 | Blath | |
| 2,522,120 | A | 9/1950 | Kaskey | |
| 2,724,133 | A | 11/1955 | Sorrell | |
| 2,759,200 | A | 8/1956 | Johnston | |
| 2,765,480 | A | * 10/1956 | Mueller | 5/640 |
| D211,244 | S | 6/1968 | Hawley | |
| 3,469,882 | A | 9/1969 | Larsen | |
| 3,574,397 | A | 4/1971 | Norriss | |
| 3,604,023 | A | 9/1971 | Lynch | |
| 3,606,461 | A | 9/1971 | Moriyama | |
| 3,757,365 | A | 9/1973 | Kretchmer | |
| 3,795,018 | A | 3/1974 | Broaded | |
| 4,007,503 | A | 2/1977 | Watkin | |
| 4,027,888 | A | 6/1977 | Wilcox | |
| D247,312 | S | 2/1978 | Zeiss | |
| 4,173,048 | A | 11/1979 | Varaney | |
| 4,177,806 | A | 12/1979 | Griffin | |
| D258,557 | S | 3/1981 | Herr | |
| 4,480,346 | A | 11/1984 | Hawkins et al. | |
| 4,571,761 | A | 2/1986 | Perlin | |
| 4,584,730 | A | 4/1986 | Rajan | |
| 4,624,021 | A | 11/1986 | Hofstetter | |
| 4,736,477 | A | 4/1988 | Moore | |
| 4,754,510 | A | 7/1988 | King | |

(List continued on next page.)

OTHER PUBLICATIONS

OrthoSupport Sleep Buddy , Downloaded Dec. 7, 2001, <http://www.orthosupport.com/sleep_buddy.htm>.
OrthoSupport Sleep Buddy Plus, Downloaded Dec. 7, 2001, <http://www.orthosupport.com/OL1032.htm>.

*Primary Examiner*—Robert G. Santos
(74) *Attorney, Agent, or Firm*—Michael Best & Friedrich LLP

(57) ABSTRACT

A pillow having a pivoting butterfly structure with two cushions pivotably interconnected by a hinge element to pivot between an open position and a closed position. Each cushion has a hinge end adjacent the hinge element, and a connecting end disposed at the end of the cushion opposite the hinge end. A middle portion is located between the hinge end and connecting end of each cushion. The cushions have a relatively flat inner surface and a curved contoured surface that extend the length of each cushion. The contoured surface projects away from the inner surface and forms two peaks near the hinge end and connecting end of each cushion. Between the peaks, the contoured surface curves inward back toward the inner surface and forms a concave groove near the middle portion of each cushion. A cover encases both cushions and contours the shapes of the cushions.

29 Claims, 3 Drawing Sheets

U.S. PATENT DOCUMENTS

| | | | | | |
|---|---|---|---|---|---|
| 4,759,089 | A | | 7/1988 | Fox | |
| D306,245 | S | | 2/1990 | Akhtarekhavari | |
| 4,910,818 | A | | 3/1990 | Grabill et al. | |
| D319,751 | S | | 9/1991 | Hoff | |
| D321,562 | S | | 11/1991 | Ljungvall | |
| 5,117,522 | A | | 6/1992 | Everett | |
| 5,125,123 | A | | 6/1992 | Engle | |
| 5,216,771 | A | | 6/1993 | Hoff | |
| D341,509 | S | * | 11/1993 | Evans | D6/502 |
| D358,957 | S | | 6/1995 | Propp | |
| 5,530,980 | A | * | 7/1996 | Sommerhalter, Jr. | 5/648 |
| D374,146 | S | | 10/1996 | Bonaddio et al. | |
| 5,572,757 | A | | 11/1996 | O'Sullivan | |
| 5,644,809 | A | | 7/1997 | Olson | |
| 5,664,271 | A | * | 9/1997 | Bellavance | 5/648 X |
| 5,682,633 | A | | 11/1997 | Davis | |
| D390,405 | S | | 2/1998 | Jung | |
| 5,746,218 | A | * | 5/1998 | Edge | 5/648 X |
| D394,977 | S | * | 6/1998 | Frydman | D6/601 |
| D417,579 | S | | 12/1999 | Tarquinio | |
| 6,047,419 | A | | 4/2000 | Ferguson | |
| 6,154,905 | A | * | 12/2000 | Frydman | 5/648 |
| 6,182,311 | B1 | * | 2/2001 | Buchanan et al. | 5/632 |
| 6,182,314 | B1 | * | 2/2001 | Frydman | 5/648 |
| 6,202,232 | B1 | | 3/2001 | Andrei | |
| D446,305 | S | * | 8/2001 | Buchanan et al. | D24/183 |
| 6,347,421 | B1 | * | 2/2002 | D'Emilio | 5/636 |
| 6,438,779 | B1 | * | 8/2002 | Brown | 5/648 |
| 2001/0027577 | A1 | * | 10/2001 | Frydman | 5/648 |
| 2002/0088057 | A1 | * | 7/2002 | Wassilefsky | 5/648 |
| 2003/0005521 | A1 | * | 1/2003 | Sramek | 5/648 |

* cited by examiner

LEG SPACER PILLOW

This application is a continuation-in-part of U.S. application Ser. No. 29/137,361, filed Feb. 16, 2001, the entire contents of which is herein incorporated by reference.

FIELD OF THE INVENTION

This invention relates to pillows or cushions, and more particularly to a pillow or cushion for therapeutic use.

BACKGROUND OF THE INVENTION

The legs of a person lying in a supine, or sidelying, position are generally out of alignment with the person's back and spine. This is commonly caused by the fact that a person's back and legs slope downward from a high point near the hips when the person lies in a supine position. Pillows, cushions, and other support devices are used to separate a person's legs, and slightly elevate the upper leg to bring the legs into proper alignment with the person's back. Conventional head pillows have often been used to separate a person's legs for this purpose. In addition, other pillows have been specially designed to serve this purpose as well.

SUMMARY OF THE INVENTION

One embodiment of the present invention provides a pillow having a pivoting butterfly design affording movement of the pillow components between a closed position and a splayed open position. This convertible features provides a versatile pillow that can be used for a variety of purposes. The pillow can be used to support and align a person's head, elevate a person's legs, space a person's legs, or perform a variety of similar functions.

In one embodiment, the pillow includes two cushions that are pivotably interconnected by a hinge element. The hinge element interconnects the pillows near the end of each cushion, and the cushions may pivot between an open position and a closed position. Each cushion has a hinge end at the end of the cushion near the hinge element, a connecting end located at the end of the cushion opposite the hinge end, and a middle portion between the hinge end and the connecting end.

The cushions each have a relatively flat inner surface and a curved contoured outer surface that each extend the length of the cushion. The contoured surface projects away from the inner surface near the hinge end and connecting end and forms two peaks on each cushion. Between the peaks, the contoured surface curves inward back toward the inner surface and forms a concave groove near the middle portion of each cushion. Relatively flat lateral faces extend along the sides of the cushions, and are bordered by the inner surface and the contoured surface.

A cover encases the cushions, and contours to the shape of the cushions. The cover is removable and has a resealable slot through which the cushions may be inserted or removed. The slot extends across the portion of the cover adjacent the inner surfaces of the cushions. A zipper is preferably used to open and close the slot. Attachment elements are located near each end of the slot adjacent the connecting ends of the cushions. The attachment elements are preferably hook and loop fasteners, and secure the connecting ends of the cushions to one another to hold the pillow in a closed position.

As mentioned above, the pillow is pivotable between an open position and a closed position. When the pillow is in the open position, the pillow extends lengthwise such that the connecting ends are separated and located at opposite ends of the pillow, and the hinge ends are adjacent to one another near the center of the pillow. When the pillow is in the closed position, the pillow folds back upon itself and the inner surfaces of the cushions face each other. The hinge ends are adjacent to one another at one end of the pillow, and the connecting ends are adjacent to one another at the opposite end of the pillow.

Figure 1:
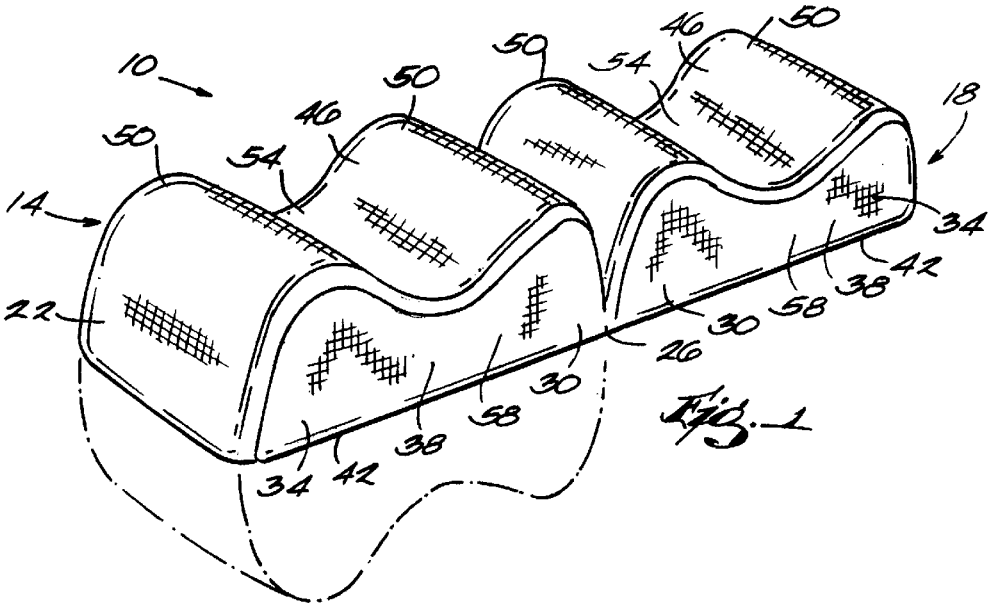
FIG. 1 is a perspective view illustrating a pillow embodying the invention, showing the pillow in an open position.

Before the embodiments of the invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 2:
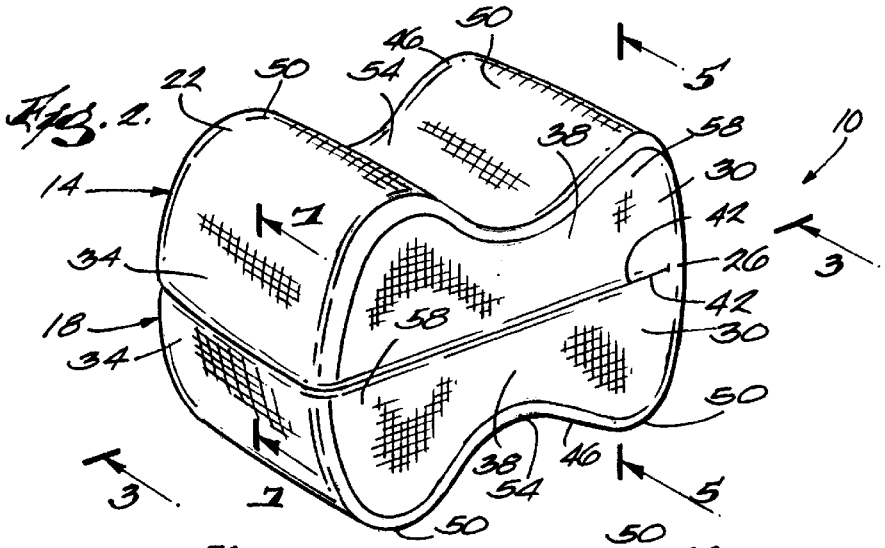
FIG. 2 is a perspective view illustrating the pillow shown in FIG. 1, showing the pillow in a closed position.

FIGS. 1–7 illustrate pillow 10 of the present invention having a pivoting butterfly structure. As shown in FIG. 1, the pillow 10 comprises a first cushion 14, a second cushion 18, and a cover 22. In the preferred embodiment, the cushions 14, 18 are substantially similar in construction and configuration. However, alternative embodiments may incorporate cushions 14, 18 having different shapes, materials, etc. The first cushion 14 and the second cushion 18 are pivotably interconnected by a hinge element 26, and the pillow 10 may pivot between an open position and a closed position. FIG. 1 illustrates the pillow 10 in the open position, and FIG. 2 illustrates the pillow 10 in a closed position.

Each cushion 14, 18 has a hinge end 30, a free or connecting end 34, and a middle portion 38. The hinge end 30 is a portion of the cushion 14, 18 located adjacent the hinge element 26. The connecting end 34 is a portion of the cushion 14, 18 located opposite the hinge end 30. The middle portion 38 is located between the hinge end 30 and the connecting end 34. When the pillow 10 is in the open position, as shown in FIG. 1, two connecting ends 34 are at opposite ends of the pillow 10, and the hinge ends 30 are near the center of the pillow 10. When the pillow 10 is in the closed position, as shown in FIG. 2, the connecting ends 34 are positioned together at one end of the pillow 10, and the hinge ends 30 are positioned together at the opposite end of the pillow 10.

Figure 3:
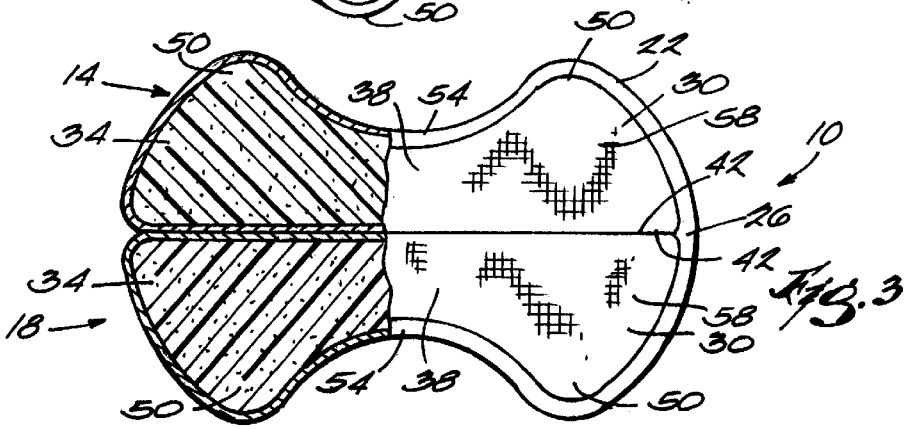
FIG. 3 is a cut away view taken along line 3—3 of FIG. 2.

A relatively flat inner surface 42 and a curved contoured surface 46 extend across the length of each cushion 14, 18 from the hinge end 30 to the connecting end 34. The inner surface 42 and the contoured surface 46 intersect at both ends of the cushion 14, 18. The contoured surface 46 projects away from the inner surface 42 near the hinge end 30 and the connecting end 34 to form two peaks 50 on each cushion 14, 18. The contoured surface 46 also curves back toward the inner surface 42 between the peaks 50 to form a concave groove 54 near the middle portion of each cushion 14, 18. The contoured surface with the peaks 50 and groove 54 provide the cushions 14, 18 with a bactrian-shaped profile when viewed from the side, as illustrated in FIG. 3. As shown in FIG. 1 and 2, each cushion 14, 18 also has two lateral faces 58 that extend along the sides of the cushion 14, 18. In the preferred embodiment, the lateral faces 58 are relatively flat, and are bordered by the contoured surface 46 and the inner surface 42.

When the pillow 10 is in the open position, as shown in FIG. 1, the inner surfaces 42 both face in a first direction, and the contoured surfaces 46 both face in a second direction that is opposite the first direction. When the pillow 10 is in the closed position, as shown in FIG. 2, the pillow 10 is folded back such that the inner surfaces 42 are adjacent and in opposed facing relation, and contoured surfaces 46 both face away from one another in opposite directions.

The cushions 14, 18 are resilient continuous members preferably made from a single piece of material. In the preferred embodiment, the cushions 14, 18 are made from a visco-elastic foam material. The visco-elastic foam material possesses specific thermally activated properties which causes the foam surface to conform to the shape of the person's body part that contacts the pillow 10. Specifically, the visco-elastic foam has a lower compression coefficient at an elevated temperature as compared to the compression coefficient at a cooler temperature. The body heat of the person acts to soften the visco-elastic foam directly contacting the body while the part of the pillow 10 not contacting the body remains in a firmer condition. This feature also allows for greater comfort and conforms the pillow 10 to the shape of the person's body part.

Figure 4:
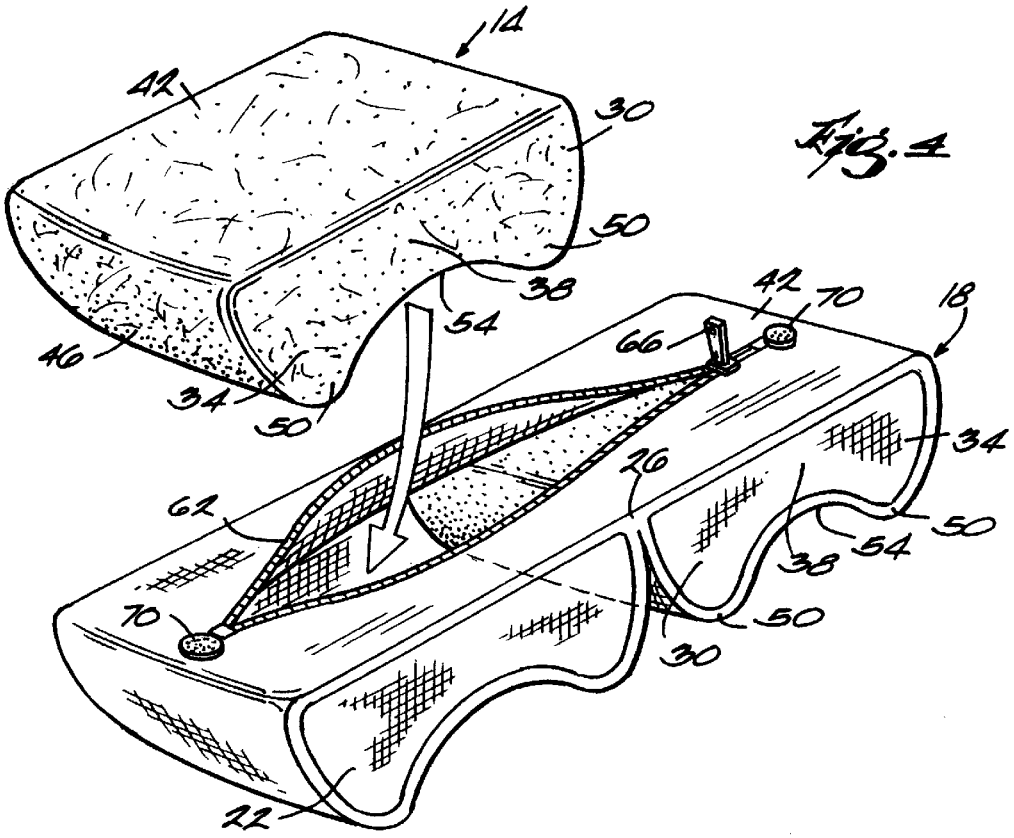
FIG. 4 is a perspective view illustrating the pillow of FIG. 1, showing the pillow partially disassembled.

The cover 22 surrounds and encases the cushions 14, 18, and conforms to the shape of the cushions 14, 18. The cover 22 is preferably made from a durable fabric material. As shown in FIG. 4, a slot 62 extends across the cover 22 along the inner surfaces 42. The cushions 14, 18 may be inserted into the cover 22 through the slot 62. The cushions 14, 18 may also be removed from the cover 22 through the slot 62 to facilitate cleaning of the cover 22. The slot 62 is resealable to close the cover 22 around the cushions 14, 18 while the pillow 10 is in use, and also to open the cover 22 for removing the cushions 14, 18. A closure device 66 is used to open and close the slot 62. In the preferred embodiment, the closure device is a zipper, although the closure device 66 could also comprise snaps, buttons, hook and loop fasteners, overlapping flaps, laces, or other similar fasteners.

Figure 7:
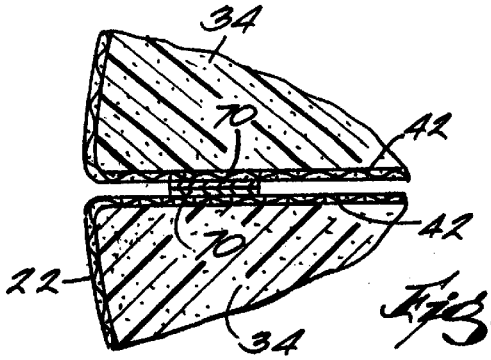
FIG. 7 is a partial cross-sectional view taken along line 7—7 of FIG. 2, illustrating attachment elements of the pillow.

Additionally, the cover 22 preferably has attachment elements 70 disposed on the cover 22 near the connecting end 34 of each cushion 14, 18. It should be understood that the attachment elements 70 are not necessary to use the pillow 10, and they are merely an optional feature. In the preferred embodiment, the attachment elements 70 may secure the connecting ends 34 together to maintain the pillow 10 in the closed position, as shown in FIG. 2. FIG. 7 illustrates the attachment elements 70 connected to one another to secure the connecting ends 34 together. The attachments elements 70 are preferably hook and loop fasteners that provide a sufficient connection to maintain the pillow 10 in the closed position, but also allow the connecting ends 34 to be easily separated to pivot the pillow 10 into the open position.

Figure 5:
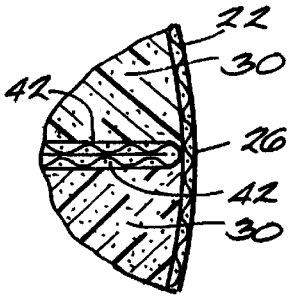
FIG. 5 is a partial cross-sectional view taken along line 5—5 of FIG. 2, illustrating a hinge of the pillow.

Another feature of the pillow 10 is the hinge element 26. As mentioned above, the hinge element 26 pivotably interconnects the cushions 14, 18. In one embodiment, as shown in FIG. 5, the hinge element 26 is formed by a part of the cover 22 between the cushions 14, 18 near the intersection of the inner surface 42 and contoured surface 46 at the hinge ends 30. The cushions 14, 18 are preferably separate portions placed into separate areas of the cover 22, and the portions are interconnected by the hinge element 26 of the cover 22. The cushions 14, 18 then may pivot about the hinge element 26 between the open and closed positions.

Figure 6:
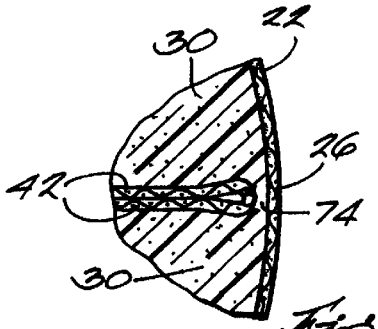
FIG. 6 is a partial cross-sectional view taken along line 5—5 of FIG. 2, illustrating an another embodiment of the hinge.

Alternatively, the cushions 14, 18 could be formed into a single piece with a thin bridging segment 74 interconnecting the two cushions 14, 18. In this alternative embodiment, as illustrated in FIG. 6, the bridging segment 74 interconnects the hinge ends 30, and permits the cushions 14, 18 to pivot between the open and closed positions. Preferably, the bridging segment 74 is made from the same material as the cushions 14, 18, and the bridging portion 74 and cushions 14, 18 are formed as one unitary piece. It is understood, however, that other materials and constructions could be used for bridging segment 74 in order to provide a long-lasting, robust hinge element between the cushions 14, 18.

The convertible pivoting butterfly structure makes the pillow 10 capable of a variety of uses. While in the open position, the pillow 10 may be used to elevate a person's legs by placing the pillow 10 under the person's legs with each cushion 14, 18 supporting a single leg. The pillow 10 could be placed anywhere along the length of the person's legs, and the person's ankles, calves, knees, or thighs would rest within the grooves 54. The pillow 10 can also be used to support a person's head while the pillow 10 is in the open position. A groove 54 could support the head of a person lying on his/her back, and the peaks 50 would maintain the head in an upright position and keep the neck in proper alignment.

While in the closed position, the pillow 10 can be used to separate a person's legs when the person is lying in a supine, or side-lying position. The closed pillow 10 is placed between the person's legs with the legs fitting into the grooves 54. The grooves 54 contour the shape of the person's legs, and the peaks 50 hold the pillow 10 between the legs and prevent the pillow 10 from accidentally falling out of position. The pillow 10 properly spaces the legs, relieves pressure, and aligns the person's legs and spine to provide several health benefits, and enhance the comfort of the user.

Figure 8:
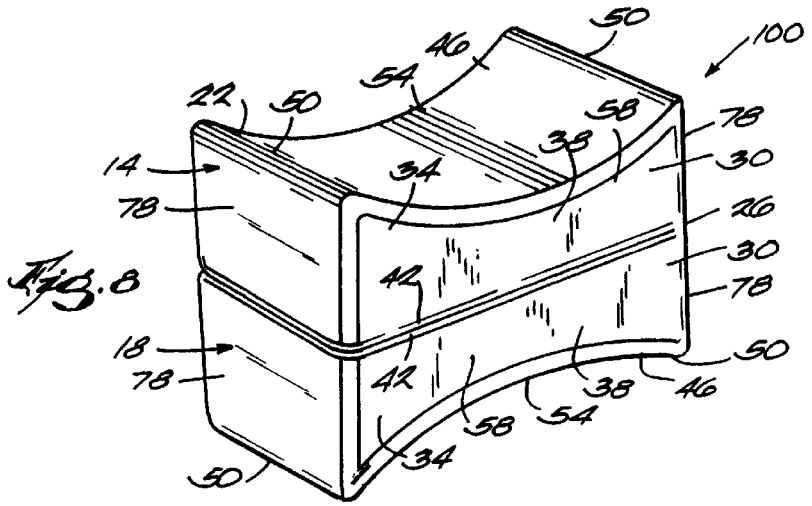
FIG. 8 is a perspective view illustrating another embodiment of the pillow embodying the present invention, showing the pillow in a closed position.
Figure 9:
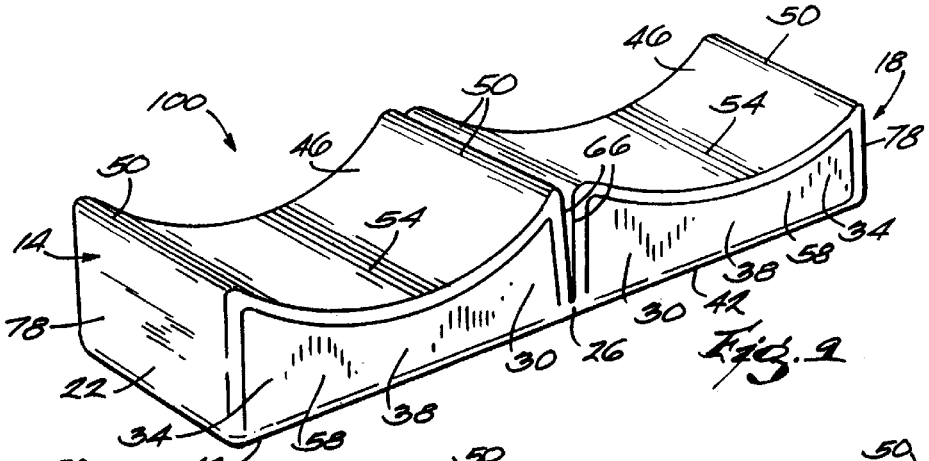
FIG. 9 is a perspective view illustrating the pillow shown in FIG. 8, showing the pillow in a open position.
Figure 10:
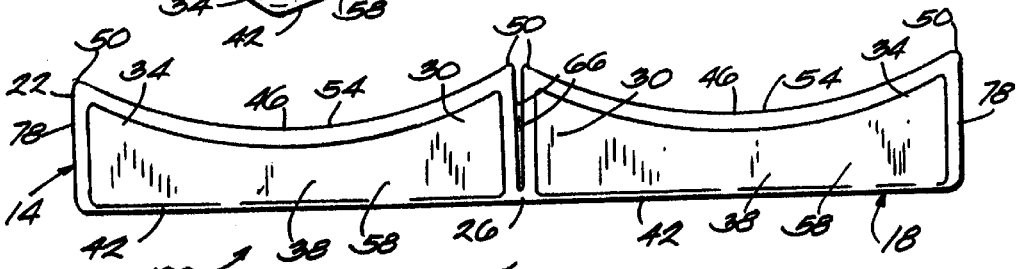
FIG. 10 is a side view illustrating the pillow shown in FIG. 9.

FIGS. 8–10 illustrate a pillow 100 which is an alternative embodiment of the present invention. The pillow 100 illustrated in FIGS. 8–10 includes all of the features described with respect to the embodiment illustrated in FIGS. 1–7, and therefore, the same reference numerals have been used to indicate like features. It should be noted that although some features are not identified by numerals in FIGS. 8–10 (such as the attachment elements 70 and the slot 62), the pillow

100 includes those features as shown and described for the pillow 10 illustrated in FIGS. 1–7. The shape of the pillow 100 differs from the shape of the pillow 10 earlier described. Specifically, in pillow 100, the cushions 14, 18 include planar end walls 78 that connect the contoured surfaces 46 and the inner surfaces 42 of the respective cushions 14, 18. The end walls 78 are parallel to each other when the pillow 100 is in the open position, and the end walls 78 adjacent to the connecting ends 34 are substantially coplanar to each other and the end walls 78 adjacent to the hinge ends 30 are coplanar to each other when the pillow 100 is in the closed position. Also, the concave groove 54 extends entirely across the cushion 14, 18, from one end wall 78 to the other end wall 78.

Various other functions of the invention are set forth in the following claims.

I claim:

1. A pillow comprising:

a first cushion and a second cushion pivotably interconnected by a hinge element, each cushion having
- a hinge end disposed adjacent to the hinge element,
- a connecting end disposed opposite to the hinge end,
- a middle portion disposed between the hinge end and the connecting end, and
- a contoured surface extending between the hinge end and the connecting end, the contoured surface having a concave groove to provide support for a person's leg, the concave groove sloping from the hinge end and the connecting end to the middle portion.

2. The pillow of claim 1, wherein the concave groove of each cushion extends entirely across the hinged end, the middle portion, and the connecting end.

3. The pillow of claim 1, wherein both cushions are made from a visco-elastic foam material.

4. The pillow of claim 1, wherein the first cushion and the second cushion are substantially similar to one another.

5. The pillow of claim 1, further comprising an interconnecting segment that connects the hinge ends of the first and second cushions such that the hinge element is at least partially formed by the interconnecting segment.

6. The pillow of claim 5, wherein the interconnecting segment is made from the same material as the cushions.

7. The pillow of claim 1, wherein each cushion further includes an inner surface that extends between the hinge end and the connecting end and that is disposed opposite to the contoured surface.

8. The pillow of claim 7, wherein each inner surface is planar.

9. The pillow of claim 7, wherein each cushion further includes a first lateral face that is bordered by the inner surface and the contoured surface, and a second lateral face that is bordered by the inner surface and the contoured surface and that is disposed opposite to the first lateral face.

10. The pillow of claim 9, wherein the first and second lateral faces of the first cushions are parallel.

11. The pillow of claim 7, wherein the first cushion and the second cushion are pivotable between an open position in which the inner surfaces face the same direction, and a closed position in which the inner surfaces face one another.

12. The pillow of claim 11, wherein each cushion further includes an attachment element near the connecting end.

13. The pillow of claim 12, wherein the attachment elements secure the connecting ends of the cushions to hold the pillow in the closed position.

14. The pillow of claim 12, wherein the attachment element of each cushion is disposed on the inner surface.

15. The pillow of claim 14, wherein the attachment elements are hook and loop fasteners.

16. The pillow of claim 1, further comprising a cover that encases the first and second cushions.

17. The pillow of claim 16, wherein each cushion includes a shape, and wherein the cover matches the shape of the cushions.

18. The pillow of claim 16, wherein a portion of the cover forms the hinge element.

19. The pillow of claim 16, wherein the cover has a slot such that the cushions can be selectively removed from and inserted into the cover through the slot.

20. The pillow of claim 19, wherein the slot includes a closure device for selectively opening and closing the slot.

21. The pillow of claim 20, wherein the closure device is a zipper.

22. A pillow comprising:

a first cushion having a hinge end, a free end opposite the hinge end, a middle portion disposed between the hinge end and the free end and providing a contoured surface between the hinge end and the free end, the contoured surface having a concave groove to provide support for a person's appendage, the concave groove sloping from the hinge end and the free end to the middle portion;

a second cushion having a hinge end, a free end opposite the hinge end, a middle portion disposed between the hinge end and the free end; and a hinge element pivotably interconnecting the first and second cushion.

23. The pillow of claim 22, wherein the middle portion of the second cushion includes a concave groove to provide support for a person's appendage.

24. The pillow of claim 22, wherein the first cushion and the second cushion have a similar configuration.

25. The pillow of claim 22, further comprising an interconnecting segment that connects the hinge ends of the first and second cushions such that the hinge element is at least partially formed by the interconnecting segment.

26. The pillow of claim 22, wherein the first and second cushion each include an inner surface that extends between the hinge end and the free end and that is disposed opposite to the contoured surface.

27. The pillow of claim 26, wherein the first cushion and the second cushion are pivotable between an open position in which the inner surfaces face the same direction, and a closed position in which the inner surfaces face one another.

28. A pillow comprising:

a first cushion and a second cushion pivotably interconnected by a hinge element, each cushion having
- a hinge end disposed adjacent to the hinge element,
- a connecting end disposed opposite to the hinge end,
- a middle portion disposed between the hinge end and the connecting end, and
- a contoured surface extending between the hinge end and the connecting end, the contoured surface having a concave groove near the middle portion to provide support for a person's leg, wherein each cushion further includes an inner surface that extends between the hinge end and the connecting end and that is disposed opposite to the contoured surface, wherein the first cushion and the second cushion are pivotable between an open position in which the inner surfaces face the same direction, and a closed position in which the inner surfaces face one another, wherein each cushion further includes an attachment element near the connecting end, and wherein the attachment elements secure the connecting ends of the cushions to hold the pillow in the closed position.

29. A pillow comprising:

a first cushion and a second cushion pivotably interconnected by a hinge element, each cushion having a hinge end disposed adjacent to the hinge element, a connecting end disposed opposite to the hinge end, a middle portion disposed between the hinge end and the connecting end, and a contoured surface extending between the hinge end and the connecting end, the contoured surface having a concave groove near the middle portion to provide support for a person's leg, wherein each cushion further includes an inner surface that extends between the hinge end and the connecting end and that is disposed opposite to the contoured surface, wherein the first cushion and the second cushion are pivotable between an open position in which the inner surfaces face the same direction, and a closed position in which the inner surfaces face one another, wherein each cushion further includes an attachment element near the connecting end, and wherein the attachment element of each cushion is disposed on the inner surface.

* * * * *